US009338543B2

(12) United States Patent
Huang

(10) Patent No.: US 9,338,543 B2
(45) Date of Patent: May 10, 2016

(54) EARPHONE DEVICE

(71) Applicant: Chiun Mai Communication Systems, Inc., New Taipei (TW)

(72) Inventor: Po-Sen Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 14/554,850

(22) Filed: Nov. 26, 2014

(65) Prior Publication Data

US 2015/0172801 A1 Jun. 18, 2015

(30) Foreign Application Priority Data

Dec. 18, 2013 (CN) ..... 2013 1 0696003

(51) Int. Cl.

| | |
|---|---|
| ***H04R 25/00*** | (2006.01) |
| ***H04R 1/28*** | (2006.01) |
| *H04R 1/02* | (2006.01) |
| *H04R 1/10* | (2006.01) |

(52) U.S. Cl.
CPC ..... *H04R 1/2849* (2013.01); *H04R 1/023* (2013.01); *H04R 1/1016* (2013.01)

(58) Field of Classification Search
CPC ..... H04R 1/10; H04R 1/2849; H04R 1/023
USPC ..... 381/370, 371
See application file for complete search history.

(56) References Cited

U.S. PATENT DOCUMENTS 4,905,276 A * 2/1990 Catey et al. ..... 379/450

* cited by examiner

*Primary Examiner* — Tuan D Nguyen
(74) *Attorney, Agent, or Firm* — Novak Druce Connolly Bove + Quigg LLP

(57) ABSTRACT

An earphone device includes a housing, a speaker diaphragm, and a sealing cup. The housing includes a cavity and a plurality of vent holes acoustically coupled to the cavity. The speaker diaphragm is received in the cavity and configured to produce sound. The sealing cup is hermetically closed with the housing, and has at least one opening defined therethrough. The sealing cup and the housing cooperate to define an air chamber acoustically coupled to both the vent holes and the opening. The vent holes are configured to transfer the sound produced by the speaker diaphragm into the air chamber. The air chamber serves as an acoustic resonator to resonate the sound. The opening is configured to allow the sound transfer from the air chamber to outside of the air chamber.

12 Claims, 5 Drawing Sheets

EARPHONE DEVICE

FIELD

The subject matter herein generally relates to earphone devices, and particularly to an acoustic tunable earphone device.

BACKGROUND

Earphones are commonly used with a variety of electronic devices to provide mobile and/or personal access to audio content. For example, earphones can be used with music players, such as MP3 and CD players. Earphones can also be used with cellular phones, personal digital assistants, computers, and most other types of electronic devices that produce audio signals. However, the acoustic performance of the conventional earphones at different frequency, such as, low frequency, middle frequency, and high frequency are not tunable.

BRIEF DESCRIPTION OF THE DRAWINGS

Implementations of the present technology will now be described, by way of example only, with reference to the attached figures.

DETAILED DESCRIPTION

Figure 1:
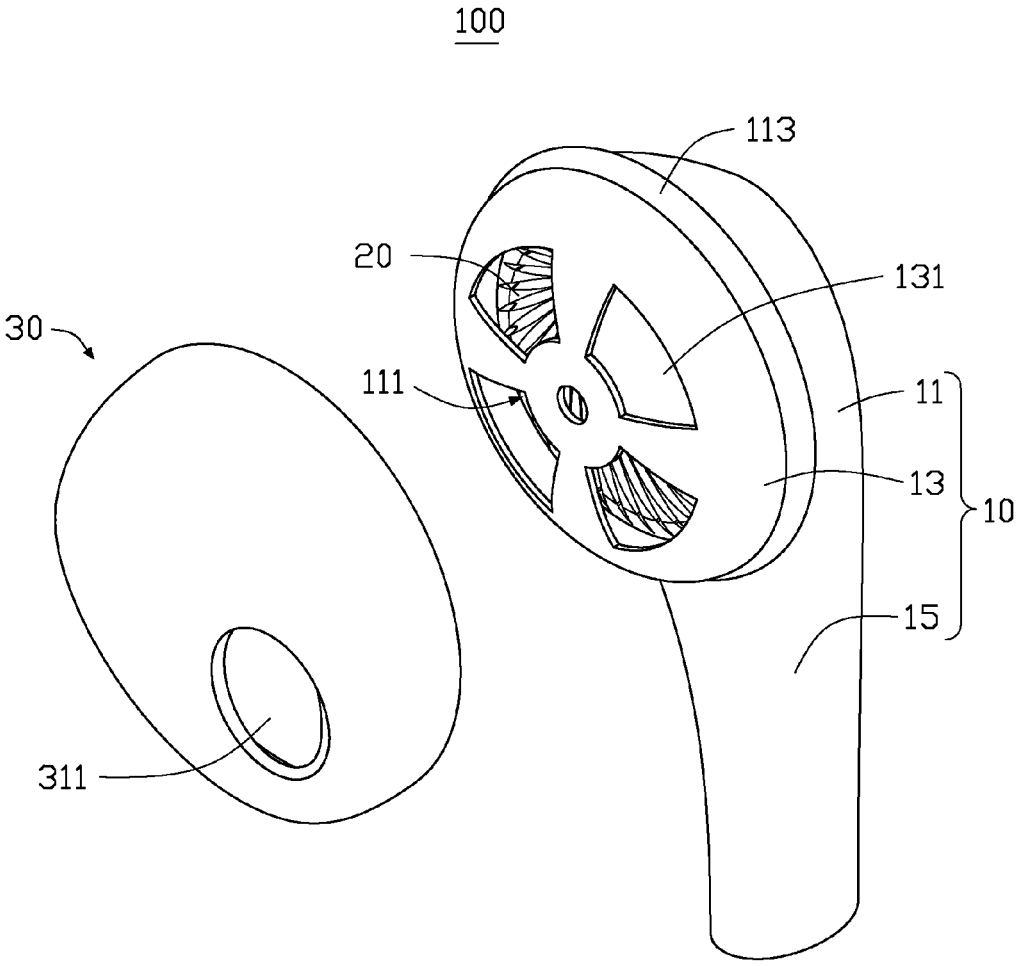
FIG. 1 is an exploded, isometric view of a first embodiment of an earphone device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an exploded, isometric view of a first embodiment of an earphone device 100. The earphone device 100 includes a housing 10, a speaker diaphragm 20, and a sealing cap 30. The housing 10 includes a cavity 111 and a plurality of vent holes 131 acoustically coupled to the cavity 111. The speaker diaphragm 20 is received in the cavity 111 and configured to produce sound.

In at least one embodiment, the housing 10 includes a main body 11 and a cover 13 fastened to the main body 11. The cavity 111 is defined inside the main body 11, and covered by the cover 13. The vent holes 131 are defined through the cover 13 and spaced from each other. The sealing cap 30 covers the cover 13 and faces the vent holes 131. A tube portion 15 is also included that extends from the main body 11. The tube portion 15 is configured to contain a cable (not shown) electronically coupled to the speaker diaphragm 20, to electronically couple the speaker diaphragm 20 to a driver (not shown).

Figure 2:
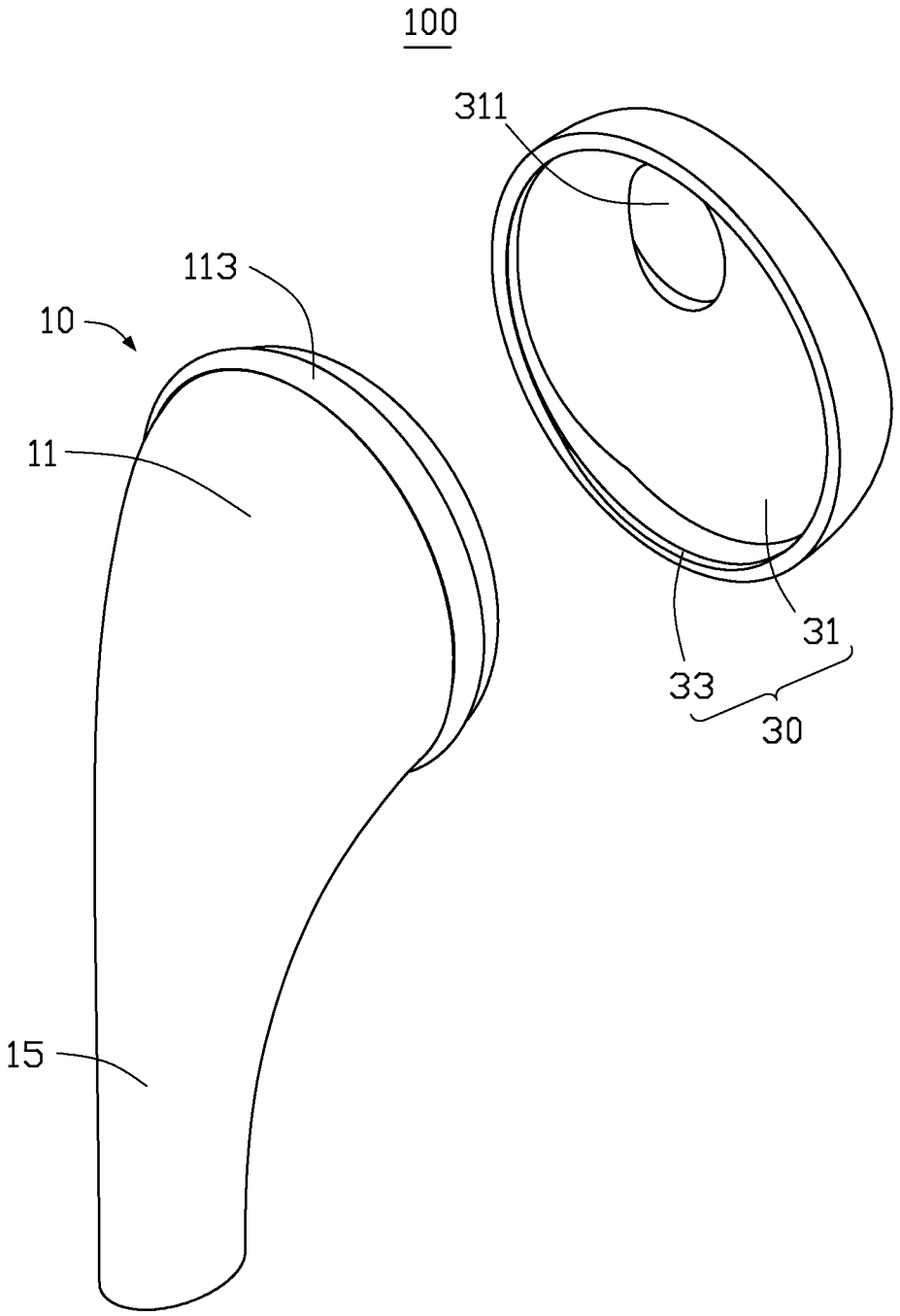
FIG. 2 is similar to FIG. 1, but showing the earphone device from another angle.

FIG. 2 is similar to FIG. 1, but showing the earphone device 100 from another angle. The sealing cap 30 is configured to hermetically close the housing 10. The sealing cap 30 includes a bottom wall 31 and a peripheral wall 33 extending from and surrounding the bottom wall 31. The main body 11 has a flange 113 protruding therefrom, the peripheral wall 33 is detachably latched to the flange 113, such that the sealing cap 30 can be detachably mounted to, and hermetically close the housing 10. In at least one embodiment, the flange 113 protrudes from and surrounds an edge of the cavity 111 (see FIG. 1). The sealing cap 30 is hemispherical.

Figure 3:
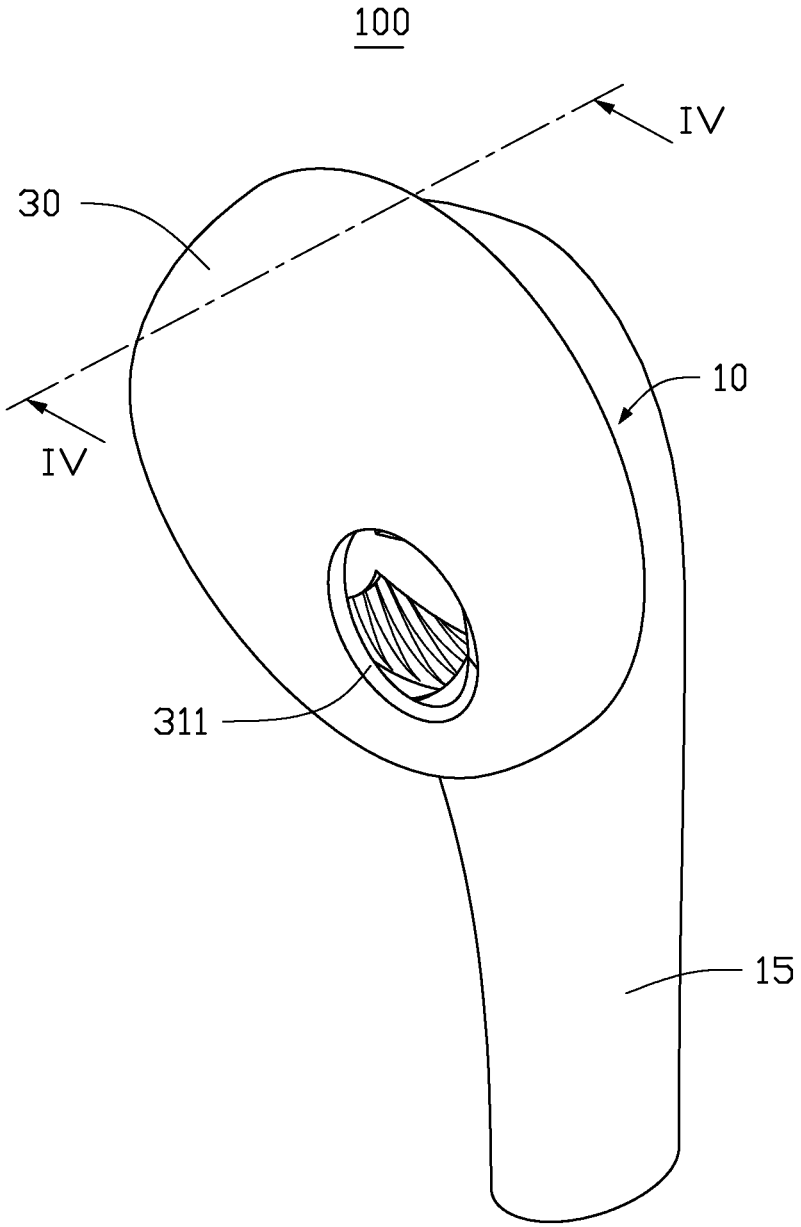
FIG. 3 is an isometric view of the earphone device as shown in FIG. 1

FIG. 3 illustrates an isometric view of the earphone device 100 as shown in FIG. 1. The sealing cap 30 covers the cover 13 and faces the vent holes 131. The sealing cap 30 includes at least one opening 311 defined therethrough. In the first embodiment, the sealing cap 30 includes one opening 311 which is defined through the bottom wall 31. When the earphone device 100 is positioned within a wearer's ear, the opening 311 aligns with the ear canal of the wear. The sealing cap 30 is typically made of resilient materials, such as rubber or silicone material.

Figure 4:
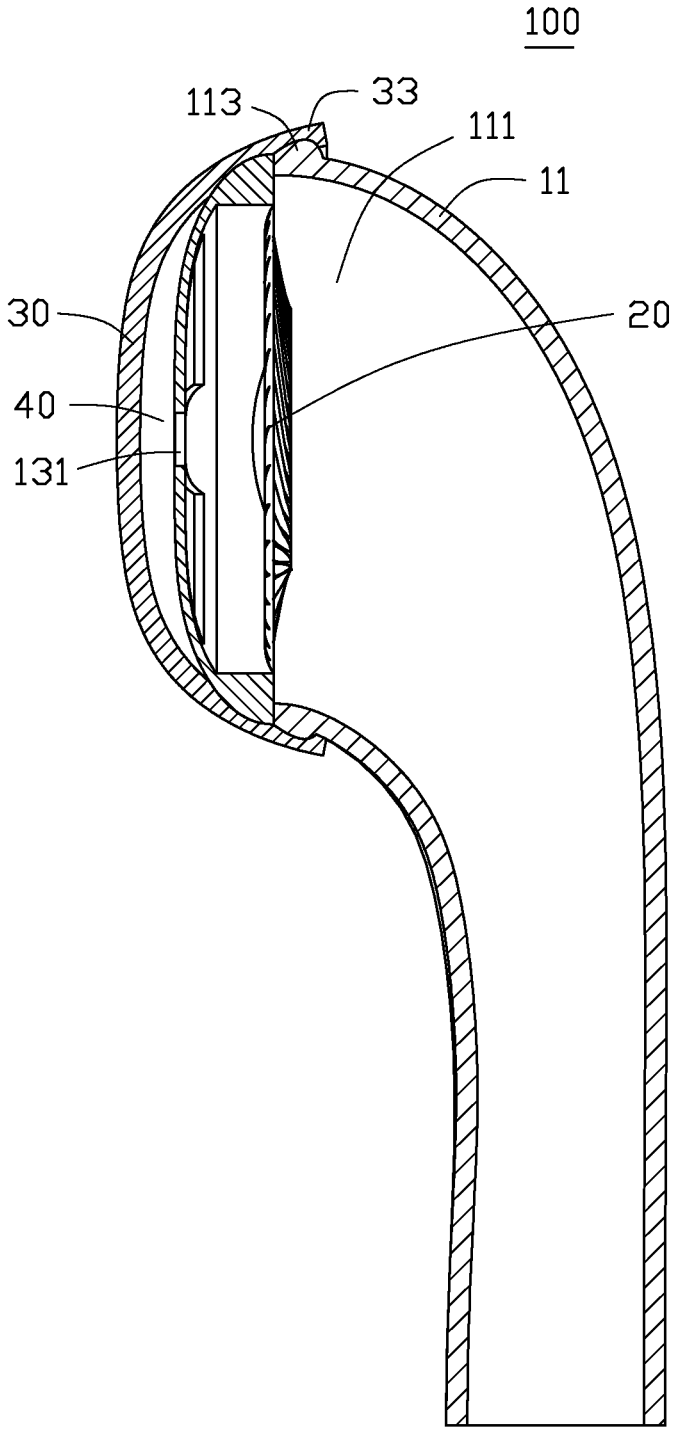
FIG. 4 illustrates a cross sectional view of the earphone device as shown in FIG. 3 along line IV-IV.

FIG. 4 illustrates a cross sectional view of the earphone 100 as shown in FIG. 3 along line IV-IV. The sealing cap 30 and the housing 10 cooperate to define an air chamber 40 acoustically coupled to both the vent holes 131 and the opening 311. The vent holes 131 are configured to transfer the sound produced by the speaker diaphragm 20 into the air chamber 40. The air chamber 40 serves as an acoustic resonator to resonate sound. The opening 311 is configured to allow the sound transfer from the air chamber 40 to outside of the air chamber 40.

For example, in use, the air chamber 40 can satisfy the principle of the Helmholtz resonator that preferentially energizes and amplifies sound waves of certain frequencies (the resonant frequencies, for example the high frequency sound wave) that is transferred from the speaker diaphragm 40 through the vent holes 131, such that the acoustic performance of the certain frequency can be improved. The resonant frequencies can be regulated by regulating the shape and size of the air chamber 40 and/or the shape, size and amount of the opening 311. Thus the opening 311 may have, for example, a circular shape, an elongated shape such as a rectangular shape or an oval shape, and any other sizes and shapes found suitable for achieving a desired acoustic performance.

Figure 5:
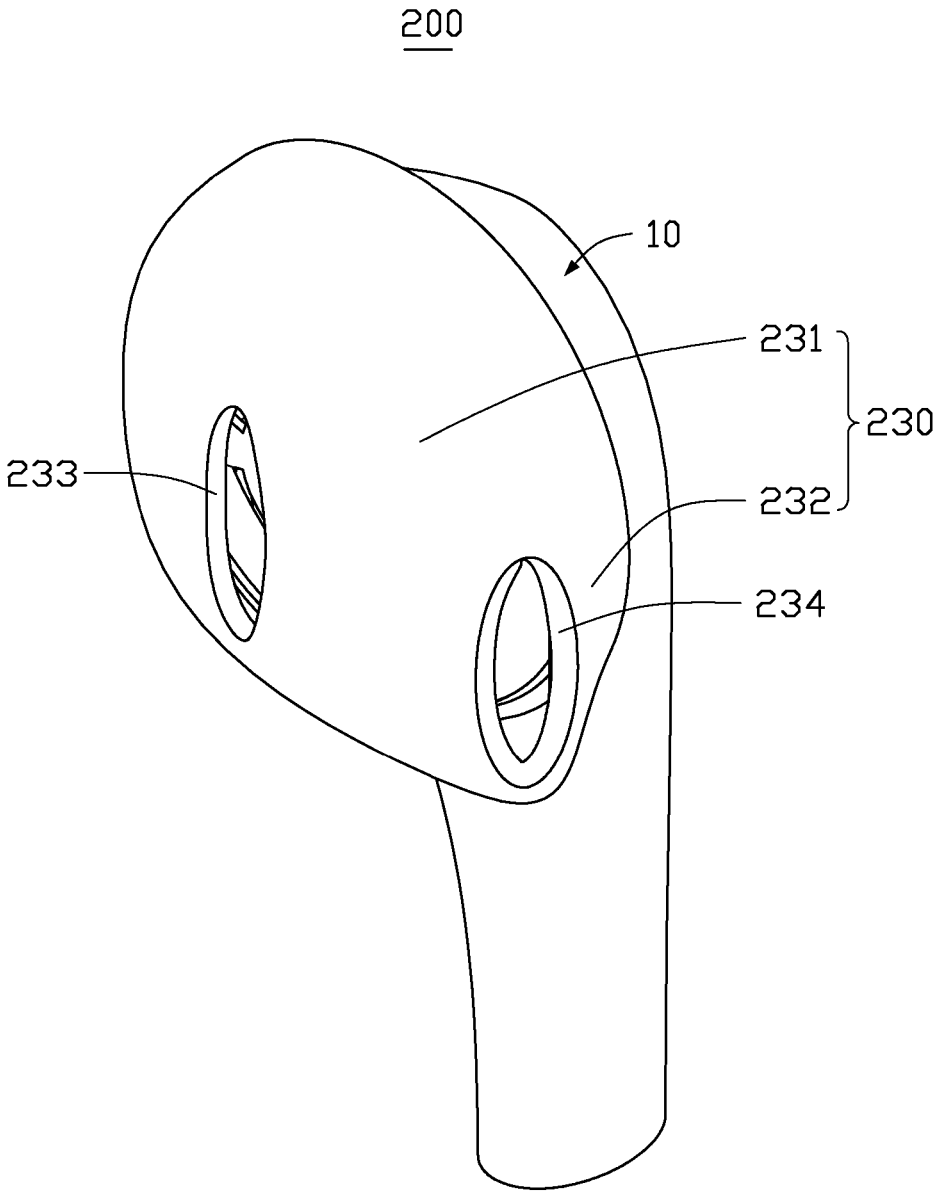
FIG. 5 is an isometric view of a second embodiment of an earphone device.

FIG. 5 illustrates an isometric view of a second embodiment of an earphone device 200. The earphone device 200 differs from the earphone device 100 only in that a sealing cap 230 of the earphone device 200 includes a bottom 231 and a peripheral wall 232 extending from and surrounding the bottom wall 231. The sealing cap 230 further includes a first opening 233 defined through the bottom wall 231 and a second opening 234 defined through the peripheral wall 232. The peripheral wall 232 is substantially perpendicular to the bottom wall 231, such that the second opening 234 is substantially perpendicular to the first opening 233. When the earphone device 200 is positioned within a wearer's ear, the second opening 234 aligns with the ear canal of the wear and output sound into the ear canal.

By replacing the sealing cup 230 with the sealing cup 30, the resonant frequencies can be regulated, such that the acoustic performance improvement at different frequency can be achieved.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An earphone device comprising:

a housing defining a cavity and a plurality of vent holes acoustically coupled to the cavity;

a speaker diaphragm received in the cavity and configured to produce sound; and a sealing cap configured to hermetically close the housing and having at least one opening defined therethrough;

wherein the sealing cap and the housing cooperate to define an air chamber acoustically coupled to both the vent holes and the opening, the vent holes are configured to transfer the sound produced by the speaker diaphragm into the air chamber, the air chamber serves as an acoustic resonator to resonate and amplify sound waves of certain frequencies, the opening is configured to allow the sound transfer from the air chamber to outside of the air chamber, and resonant frequencies are regulated by regulating shape and size of the air chamber and/or shape, size and amount of the opening.

2. The earphone device of claim 1, wherein the housing comprises a main body and a cover fastened to the main body; the cavity is defined inside the main body, and covered by the cover; and the vent holes are defined through the cover and spaced from each other; the sealing cap covers the cover and faces the vent holes.

3. The earphone device of claim 1, wherein the sealing cap comprises a bottom wall and a peripheral wall extending from and surrounding the bottom wall; the housing has a flange protruding therefrom, and the peripheral wall is detachably latched to the flange.

4. The earphone device of claim 3, wherein the flange protrudes from and surrounds an edge of the cavity.

5. The earphone device of claim 1, wherein the sealing cup comprises a bottom wall and a peripheral wall extending from and surrounding the bottom wall, the peripheral wall is substantially perpendicular to the bottom wall; the sealing cup further comprises a first opening defined through the bottom wall and a second opening defined through the peripheral.

6. The earphone device of claim 1, wherein the housing comprises a tube portion extending from the main body and configured to contain a cable electronically coupled to the speaker diaphragm.

7. An earphone device comprising:

a housing defining a cavity and a plurality of vent holes acoustically coupled to the cavity;

a speaker diaphragm received in the cavity and configured to produce sound; and a sealing cup configured to hermetically close the housing, and having at least one opening defined therethrough;

wherein the sealing cup and the housing cooperatively define an air chamber acoustically coupled to both the vent holes and the opening; the opening is configured to align with a wearer's ear canal when the earphone device is positioned within the wearer's ear, the air chamber serves as an acoustic resonator to energize and amplify sound waves of certain frequencies that are transferred from the speaker diaphragm through the vent holes, and the resonant frequencies are regulated by regulating shape and size of the air chamber and/or shape, size and amount of the opening.

8. The earphone device of claim 7, wherein the housing comprises a main body and a cover fastened to the main body; the cavity is defined inside the main body, and covered by the cover; the vent holes are defined through the cover and spaced from each other; the sealing cup covers on the cover and faces the vent holes.

9. The earphone device of claim 7, wherein the sealing cup comprises a bottom wall and a peripheral wall extending from and surrounding the bottom wall; the housing has a flange protruding therefrom, the peripheral wall is detachably latched to the flange.

10. The earphone device of claim 9, wherein the flange protrudes from and surrounds an edge of the cavity.

11. The earphone device of claim 7, wherein the sealing cup comprises a bottom wall and a peripheral wall extending from and surrounding the bottom wall, the peripheral wall is substantially perpendicular to the bottom wall; the sealing cup further comprises a first opening defined through the bottom wall and a second opening defined through the peripheral.

12. The earphone device of claim 7, wherein the housing comprises a tube portion extending from the main body and configured to contain a cable electronically coupled to the speaker diaphragm.

* * * * *